US005324168A

United States Patent [19]

Corbelli et al.

[11] Patent Number: 5,324,168

[45] Date of Patent: Jun. 28, 1994

[54] USE OF STELLITE TO PREVENT SILVER PLATEOUT

[75] Inventors: Paul A. Corbelli, LeRoy; Peter J. Despard, Hamlin; Walter Johannes, Rochester, all of N.Y.

[73] Assignee: Eastman Kodak Company, Rochester, N.Y.

[21] Appl. No.: 61,128

[22] Filed: May 13, 1993

[51] Int. Cl.[5] ..... F01D 5/28

[52] U.S. Cl. ..... 415/200

[58] Field of Search ..... 415/200

[56] References Cited

U.S. PATENT DOCUMENTS

| | | | |
|---|---|---|---|
| 3,576,377 | 4/1971 | Beanland et al. | 416/191 |
| 3,797,085 | 3/1974 | Aartman | 29/156.8 R |
| 4,215,976 | 8/1980 | Neumann | 415/101 |
| 4,318,672 | 3/1982 | Hansen | 416/224 |
| 4,443,152 | 4/1984 | Wong et al. | 415/143 |
| 4,470,606 | 9/1984 | Knowles | 277/4 |
| 4,475,866 | 10/1984 | Kambe et al. | 415/112 |
| 4,770,606 | 9/1988 | Kuroiwa | 415/199.1 |
| 5,117,633 | 6/1992 | Bayer et al. | 60/431 |

*Primary Examiner*—John T. Kwon

*Attorney, Agent, or Firm*—Carl F. Ruoff

[57] ABSTRACT

The present invention is the use of stellite material for all contact surfaces between moving parts and a metering pump pumping silver photographic emulsion. All parts that are in contact with the solutions containing silver made of stellite will prevent failure of rotating assemblies due to metallic silver plateout between rotating parts. Prior art pumps exhibited silver plateout after very few hours of operation.

2 Claims, 2 Drawing Sheets

USE OF STELLITE TO PREVENT SILVER PLATEOUT

FIELD OF THE INVENTION

The present invention relates to the use of pumps for delivering silver photographic emulsions. More specifically, the present invention is a pump which prevents silver plateout of silver photographic emulsions.

1. Background of the Invention

A major problem with existing metering pumps when delivering silver photographic emulsions is the failure of the metering pumps due to seizing from silver plateout between the rotating parts. This failure necessitates interrupting coating events to replace seized pumps or scheduling frequent pump changes to reduce unscheduled interruptions which also involves production shut down. All commercially available metering pumps are made of stainless steel or other alloys which have a problem with silver plateout.

In U.S. Pat. No. 4,318,672 and 3,576,377, the use of stellite, a cobalt based metal, has been shown to improve wear resistance and abrasion resistance in blade fans and turbines. Likewise, in U.S. Pat. No. 4,443,152 the use of stellite for the blades of an axial slurry pump to improve abrasion resistance is suggested. Finally, in U.S. Pat. No. 4,475,866 the use of stellite and a liquid metal mechanical pump to improve wear resistance is also taught. However, the use of stellite to prevent silver plateout in a photographic emulsion processing pump is not suggested by these references.

The present invention solves the problem of silver plateout in silver photographic emulsion processing pumps. This is accomplished by providing a pump for pumping silver halide containing fluid compositions wherein all parts of the pumps in direct contact with the silver halide composition have a stellite surface.

SUMMARY OF THE INVENTION

The present invention is a method and apparatus for eliminating silver plateout from silver photographic emulsions. The method includes subjecting the photographic emulsion to shear by pumping the photographic emulsion through a pump which has been made from stellite such that the silver in the photographic emulsion which contacts the pump surfaces do not plateout silver.

The apparatus of the present invention is a pump which includes a pump housing made of stellite, a rotatable drive shaft made of stellite axially positioned through said housing, a stationary drive shaft made of stellite axially positioned through said housing, pump gears made of stellite fixedly secured to said rotatable shaft and rotating around said stationary drive shaft when said rotatable drive shaft is rotated and bushings made of stellite for securing said rotatable drive shaft to said pump housing wherein when said photographic emulsion is pumped the liquid contacts the pump housing, the rotatable drive shaft, the stationary drive shaft, the pump gears and the bushings.

For a better understanding of the present invention, together with other advantages and capabilities thereof, reference is made to the following detailed description and claims in connection with the above-described drawings.

DETAILED DESCRIPTION OF THE PREFERRED EMBODIMENT

The present invention is the use of stellite material, a cobalt alloy, for all surfaces of a pump that are in contact with photographic emulsions or solutions containing silver. This will prevent failure of the rotating assemblies due to metallic silver plateout between the rotating of parts of the pump. Such a problem occurs in prior art pumps. The same technology is also applicable to any rotating mechanism that has problems with metallic silver plateout. Presently, we are aware of no other materials that have the physical strength properties required for this application and are able to inhibit metallic silver plateout.

The theory hypothesized for the localized effect of silver plateout is as follows, although applicants do not wish to be bound by this theory. It is thought that electrolysis takes place with the rotating parts creating a low electrical current and acting as electrodes in very localized areas that have the potential to build high heat from friction and shear. The stellite is believed to act as an electrical insulator, as well as to reduce heat generated due to friction between the rotating parts. The present invention will now be described in relation to the pump presently used.

Figure 1:
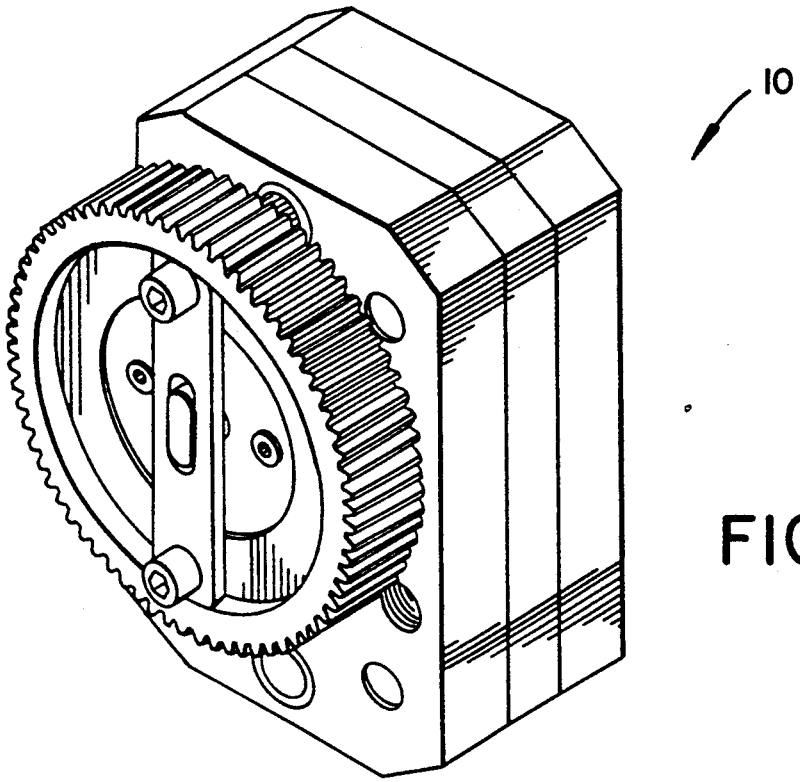
FIG. 1 shows a perspective of the pump of the present invention.
Figure 2:
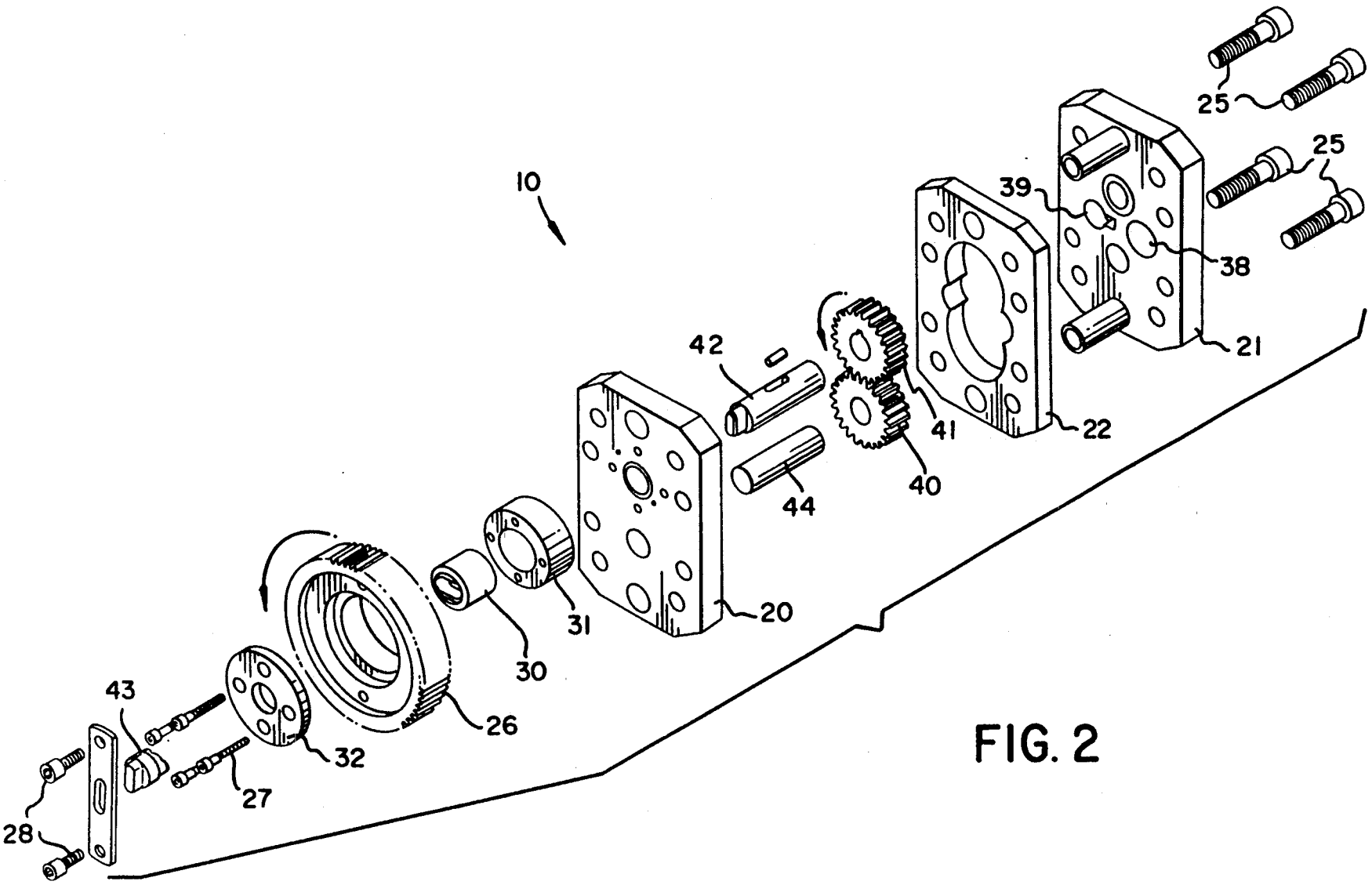
FIG. 2 shows an exploded view of the pump of the present invention.

FIG. 1 shows a pump 10 with a mechanical face seal. FIG. 2 shows an exploded view of the pump of FIG. 1. The housing of pump 10 is formed from front side plate 20, center plate 22, and rear side plate 21. These plates are held together by binder screws 25. The outer drive gear 26 is coupled to the front side plate 20 by coupling housing screws 27 and drive strap screws 28. Inside the outer drive gear 26 is a universal coupling 30 and a coupling housing 31. A seal plate 32 is attached to the outside surface of the outer drive gear 26. Two driving meter gears 40 and 41 fit inside the center plate 22. The driving meter gear 41 is driven by drive shaft 42 which is coupled to the outer drive shaft 43 through the universal coupling 30. A second rotating or nonrotating shaft 44 is attached to driven meter gear 40.

In operation the metering pump shown in FIGS. 1 and 2 works as follows. A small amount of head pressure is necessary to feed pump inlet 38. Gears 40, 41 rotate in opposite directions, carrying in between the teeth, the solution or photographic emulsion being pumped to the outlet 39. At the outlet 39, the teeth mesh extruding the solution out of the pump. Tight tolerances in all component parts keep the solution or photographic emulsion from leaking by the gears 40, 41.

The first set of tests run on the pumps of the present invention were to establish an estimate of how long the stellite pump would run before silver plateout would cause seizure. In these experiments, a stellite pump was run at 70 psi back pressure at 150 rpm (3 l/min) on silver bearing solution. Stellite pumps were run for 73 to 172 hours without failure. When the stellite pumps were stopped to examine the parts, no silver plateout was detected. From these experiments it was concluded that the stellite parts on the pump eliminate silver plateout.

Figure 3:
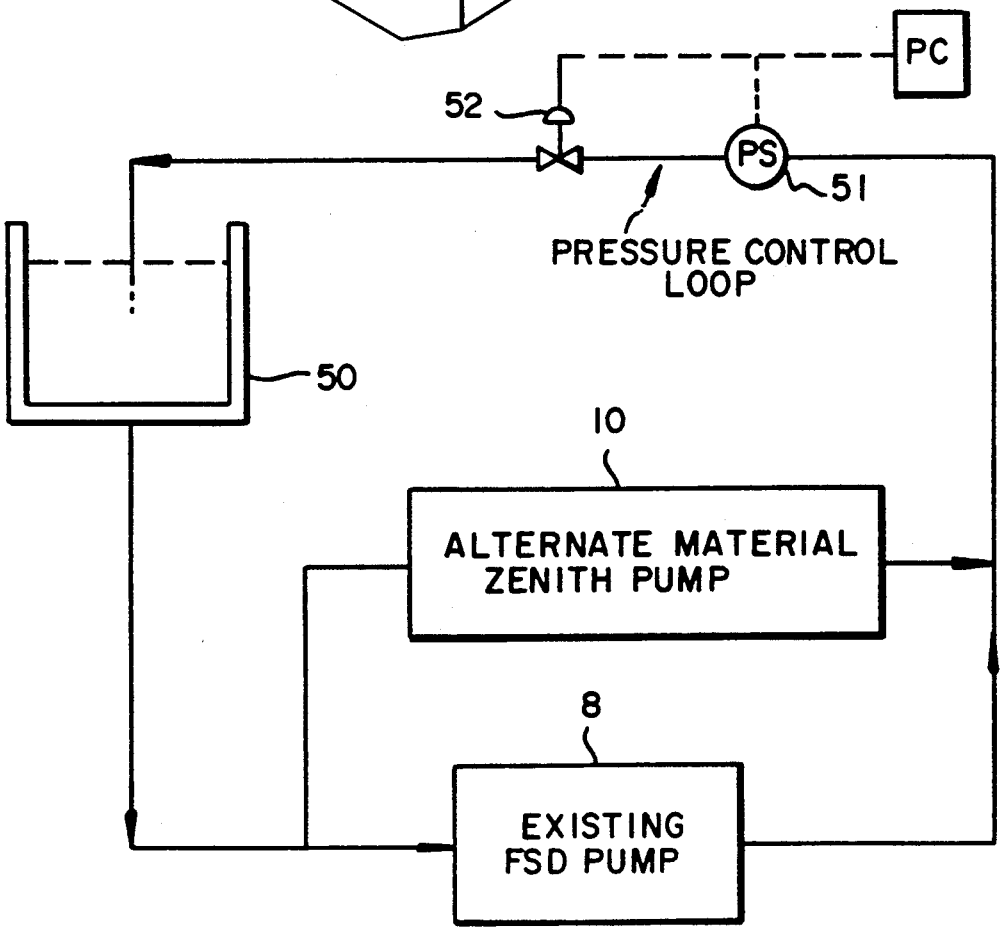
FIG. 3 is a schematic diagram of the setup used to test the pump of the present invention.

FIG. 3 shows that the experimental setup used to test the pumps of the present invention against prior art pumps. The experimental setup included kettle 50 from which a silver photographic emulsion was pumped. Depending upon the valves' (not shown) position, either the pump of the present invention 10 or a prior art pump 8 could be used to pump the silver photographic emulsion. The discharge of each pump was then directed to a pressure gauge 51 and a back pressure valve 52.

In the side-by-side tests using silver bearing gelatine solution at 110° C. and a 70 psi back pressure, the stainless steel pump 8 seized due to silver plateout after 10 minutes. The stellite pump ran 73 hours before the test was stopped. Again, no silver plateout was detected on the pump of the present invention when the pump was disassembled and inspected.

The pump of the present invention included stellite **6*b* for the shafts 40 and 42 and the front side plate 20. Stellite 3 was used for the gears 40 and 41 and for the rear side plate 21. The pump of the prior art all parts were made of 316** stainless steel.

While there has been shown and described what is at present considered to be the preferred embodiments of the invention, various alterations and modifications will be obvious to those skilled in the art. All such modifications are intended to fall within the scope of the appended claims.

What is claimed is:

1. A pump comprising:

a pump housing made of stellite;

a rotatable drive shaft made of stellite axially positioned through said housing;

a stationary drive shaft made of stellite axially positioned through said housing;

pump gears made of stellite fixedly secured to said rotatable drive shaft and rotating around said stationary drive shaft when said rotatable drive shaft is rotated;

bushings made of stellite for securing said rotatable drive shaft to said pump housing wherein when liquid is pumped, the liquid contacts said pump housing, said rotatable drive shaft, said stationary drive shaft, said pump gears and said bushings wherein photographic emulsion containing silver is the liquid pumped, thereby preventing plateout of the silver in the photographic emulsion.

2. A method of eliminating silver plateout from photographic emulsions comprising:

pumping the photographic emulsion through a pump wherein all the contact surfaces of the pump with the emulsion are stellite and thereby preventing plateout of the silver in the photographic emulsion.

* * * * *